US009302829B1

(12) United States Patent
Niggel et al.

(10) Patent No.: US 9,302,829 B1
(45) Date of Patent: Apr. 5, 2016

(54) CLOSURE WITH CHANNEL ENTRANCE FOR A CONTAINER

(71) Applicant: Berlin Packaging, LLC, Chicago, IL (US)

(72) Inventors: Brett Niggel, St. Corry, PA (US); Andrew Sanguinet, La Grange Park, IL (US)

(73) Assignee: Berlin Packaging, LLC, Chicago, IL (US)

( * ) Notice: Subject to any disclaimer, the term of this patent is extended or adjusted under 35 U.S.C. 154(b) by 0 days.

(21) Appl. No.: 14/549,609

(22) Filed: Nov. 21, 2014

(51) Int. Cl.
*B65D 51/18* (2006.01)

(52) U.S. Cl.
CPC ..... *B65D 51/18* (2013.01)

(58) Field of Classification Search
CPC ..... B65D 51/18; B65D 47/08; B65D 47/06; B65D 43/163; B65D 43/16; B65D 1/0246; B65D 1/023
USPC ..... 215/235, 243, 237, 305, 44, 43; 220/254.3, 254.1, 259.1, 836, 810; 222/556, 544
See application file for complete search history.

(56) References Cited

U.S. PATENT DOCUMENTS 7,628,297 B2 * 12/2009 Pugne ..... B65D 47/0804 215/237
8,141,731 B2 * 3/2012 Mazurkiewicz ... B65D 47/0814 215/237

* cited by examiner

*Primary Examiner* — Robert J Hicks
(74) *Attorney, Agent, or Firm* — Adam K. Sacharoff; Much Shelist

(57) ABSTRACT

There is provided a closure having a shell and a cover. The shell includes a surface with a cap portion extending to secure around the neck of a bottle. An opening is provided to allow contents within the bottle to exit. A partition extends around the opening to define a passage for the contents. The cover has a top portion with a channel in communication with the passage and a channel mouth such that contents in the bottle exits when the cover is in an opened configuration. The cover has a divider positioned about the channel entrance and sized to seal against the partition when the cover is in a closed configuration. The cover is sized to fit within the shell when in the closed configuration and the cover pivots to an opened configuration exposing the channel mouth to allow contents to flow from the bottle.

14 Claims, 11 Drawing Sheets

CLOSURE WITH CHANNEL ENTRANCE FOR A CONTAINER

FIELD OF THE INVENTION

The present invention relates to a closure to a container or bottle.

BACKGROUND OF THE INVENTION

Many containers, particularly bottles containing dispensing fluids have closures or caps which are twisted or pulled to open a passage for dispensing the liquid, and provide a seal to close the container and prevent leaking when not in use. In addition, there are other methods for opening containers including, as proposed by an embodiment of the invention, a rocker type closure that can be rocked or pushed on one side to pivot the other end to an open position.

SUMMARY OF THE INVENTION

In one embodiment of the present invention there is provided a closure for a bottle having a neck. The closure has a shell and a cover. The shell has a main lateral surface, with a pair of diametrically opposed skirts extending therefrom. The shell further has a cap portion configured to secure around the neck of the bottle and an opening in the main lateral surface positioned about the cap portion such that contents within the bottle may flow through the main lateral surface. The shell further has an annular partition extending around the opening in a diametrically opposed direction from the cap portion to define a passage for the contents of the bottle. In addition, thee shell further includes a recessed portion defined on the main lateral surface. The cover has a top portion with a top skirt extending from the terminal edge of the top portion. The cover is sized to fit within the shell and has a channel in fluid communication with the passage when the cover is in an opened configuration. The channel includes a channel mouth exposed when the cover is in the opened configuration. The cover further includes an annular divider configured to seal against the annular partition when the cover is in a closed configuration. In addition, a pivot mechanism is configured to allow the cover to pivot in relation to the shell. When in the closed configuration the cover lies substantially flush with an edge of the shell and when the cover is pressed on an end diametrically opposed to the channel mouth the cover pivots to the opened configuration and thereby exposes the channel mouth.

In another embodiment, the cap portion further includes a first wall extending towards the neck of the bottle and a second wall extending towards the neck of the bottle and being positioned interiorly from the first wall at a distance defined by a thickness of the neck of the bottle, such that when positioned the neck of the bottle is captured between the first and second walls.

In yet another embodiment, the main lateral surface includes a ledge extending in a direction to define a recessed portion within the shell and wherein the recessed portion is positioned distal to the channel mouth of the cover and wherein the recessed portion provides a region of the shell to accommodate a portion of the cover when the cover is in the opened configuration.

In other embodiments, the pivot mechanism is configured as a pair of pivot members positioned on an exterior surface of the top skirt corresponding to a pair of recesses positioned on an interior surface of the second skirt. The pivot mechanism may further include a pair of u-shaped guides and a pair of dog ear extension members configured to rest in the u-shaped guides.

The cover may further include an outer annular divider configured to engage an outer surface of the annular partition when the closure is in both the closed and opened configurations and wherein the outer annular divider further terminates into the channel such that when the closure is in an opened configuration, the contents of the bottle are directed from the passage into the channel entrance.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
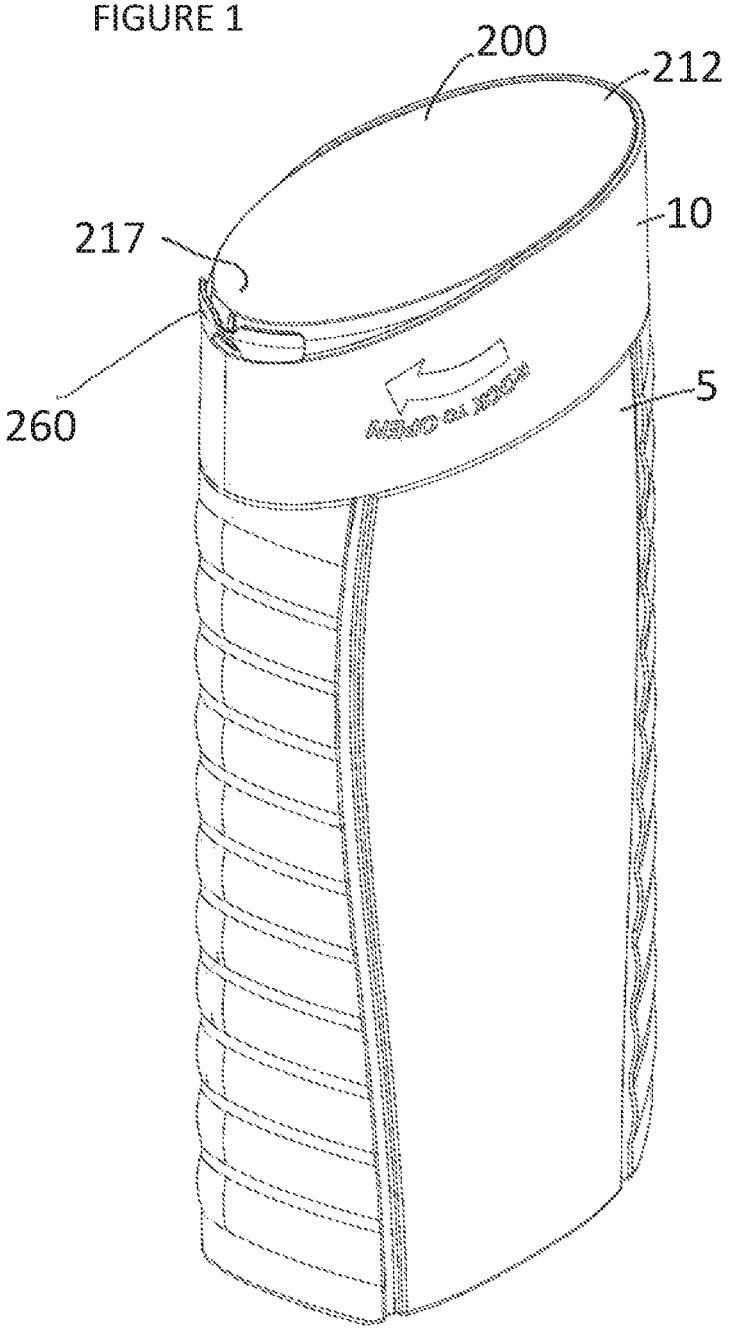
FIG. 1 is a perspective view of a closure in accordance with an embodiment of the present invention and being illustrated in a closed configuration.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
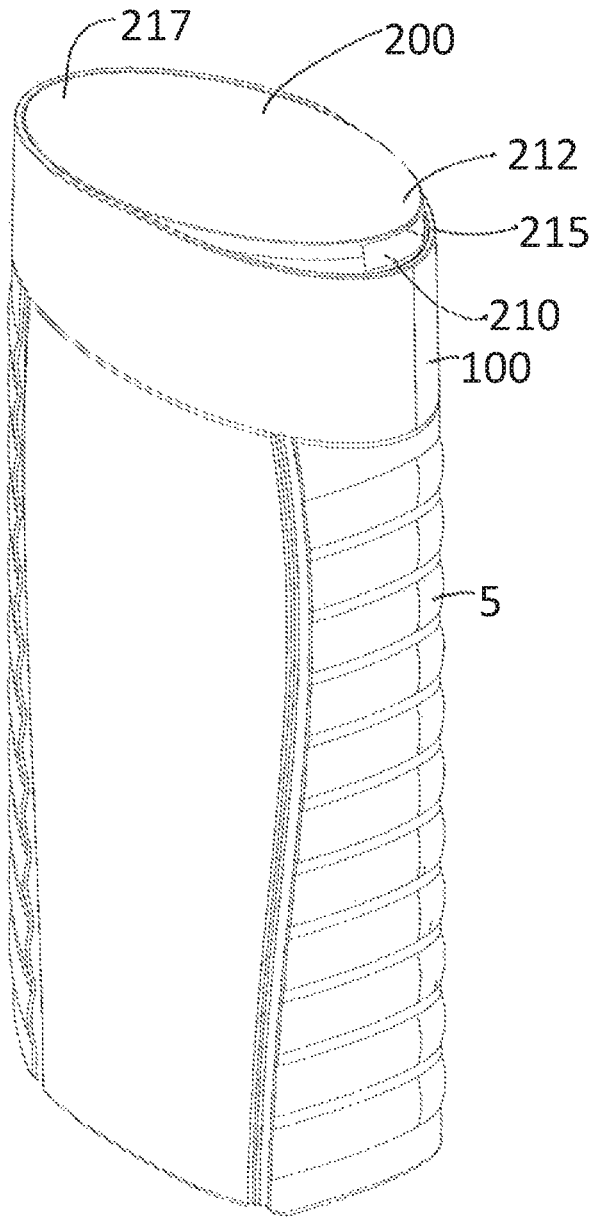
FIG. 2 is a perspective view of a closure in accordance with an embodiment of the present invention and being illustrated in an opened configuration.
Figure 3A:
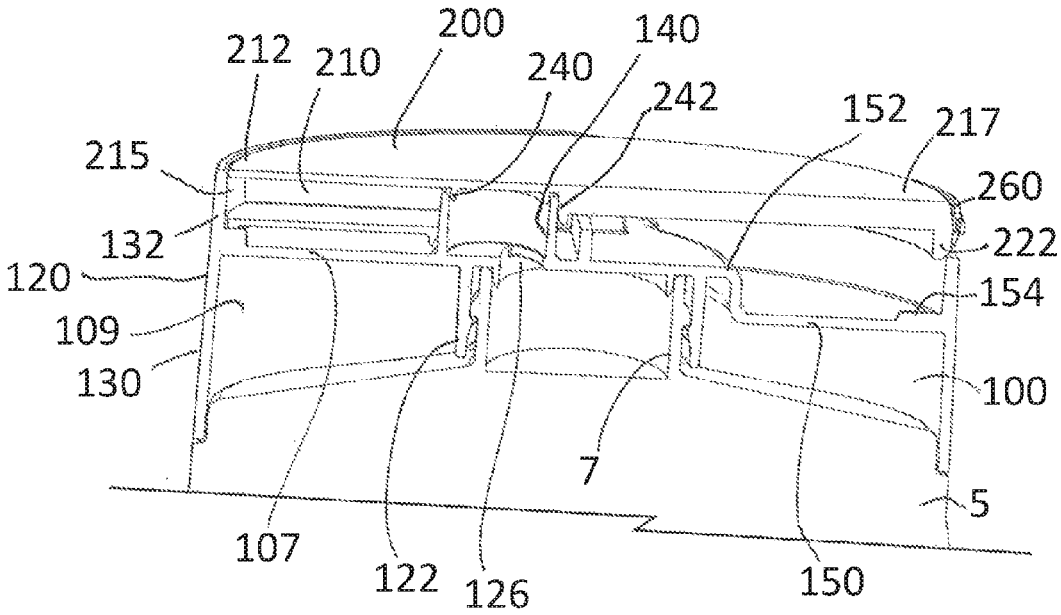
FIG. 3A is a cross sectional view of the closure in accordance with an embodiment of the present invention and illustrated in a closed configuration with a bottle.
Figure 3B:
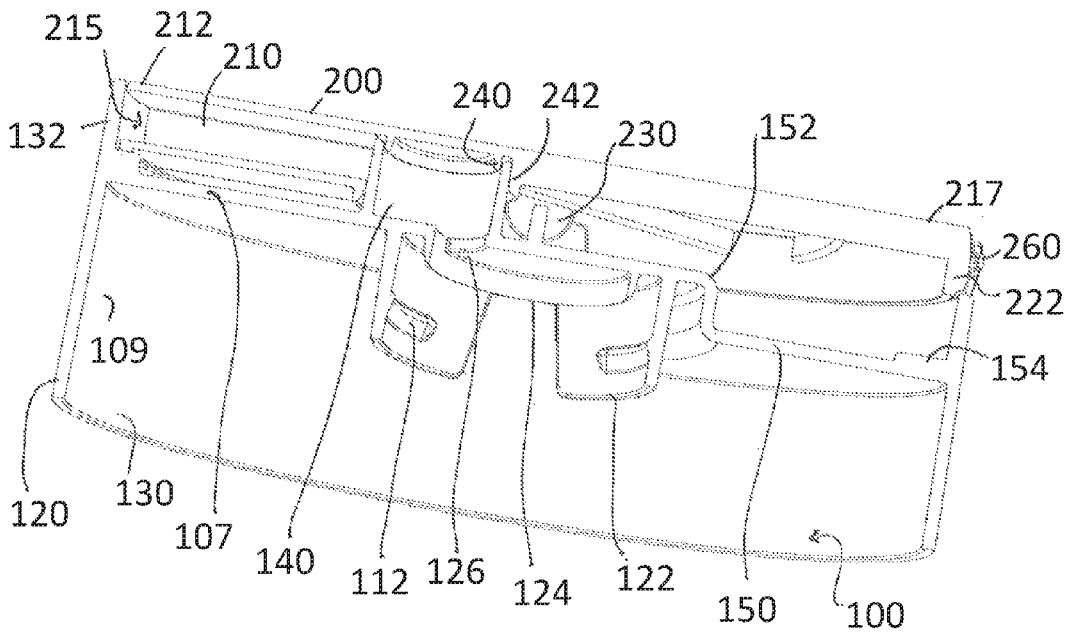
FIG. 3B is a cross sectional view of the closure in accordance with an embodiment of the present invention and illustrated in a closed configuration without a bottle.
Figure 4:
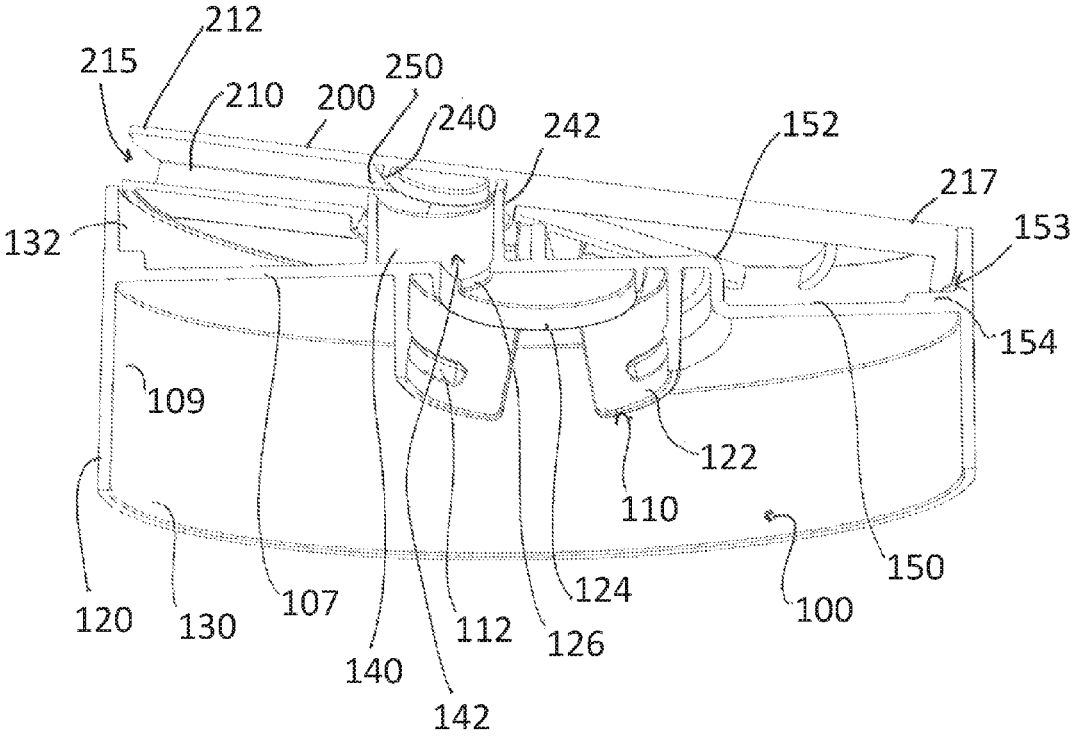
FIG. 4 is a cross sectional view of the closure in accordance with an embodiment of the present invention and illustrated in an opened configuration.
Figure 5:
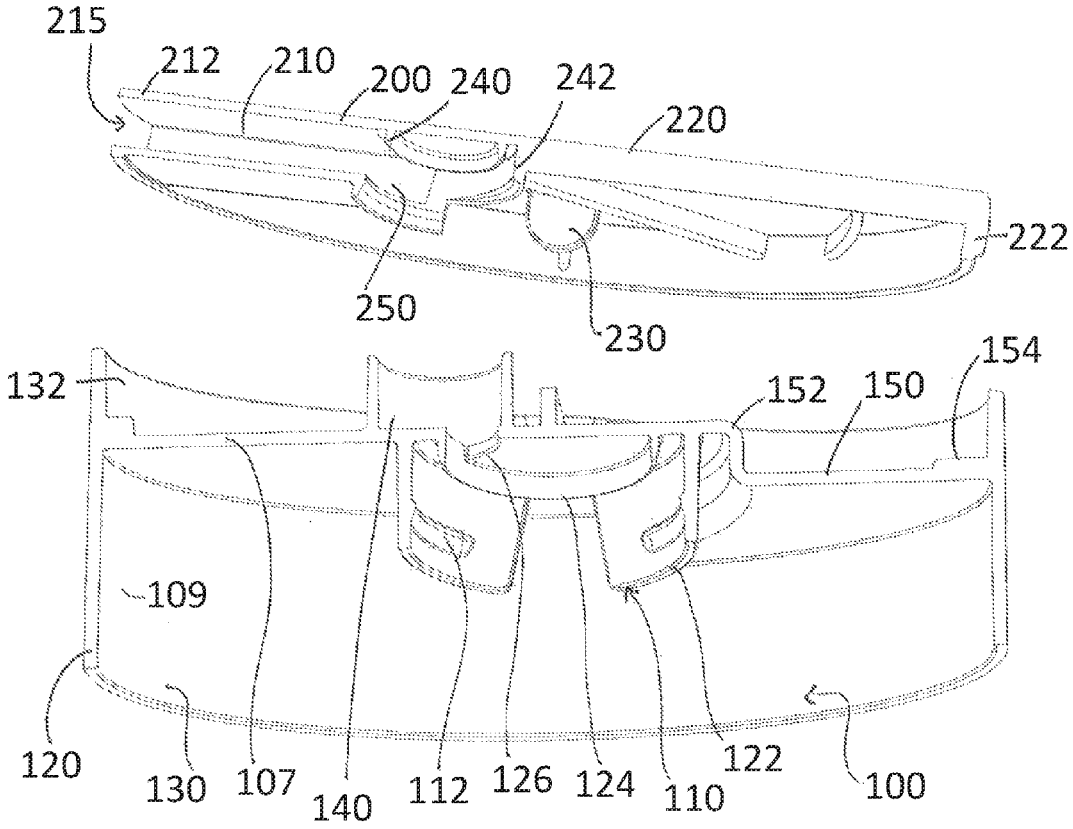
FIG. 5 is a cross sectional exploded view of a closure in accordance with an embodiment of the present invention.
Figure 6:
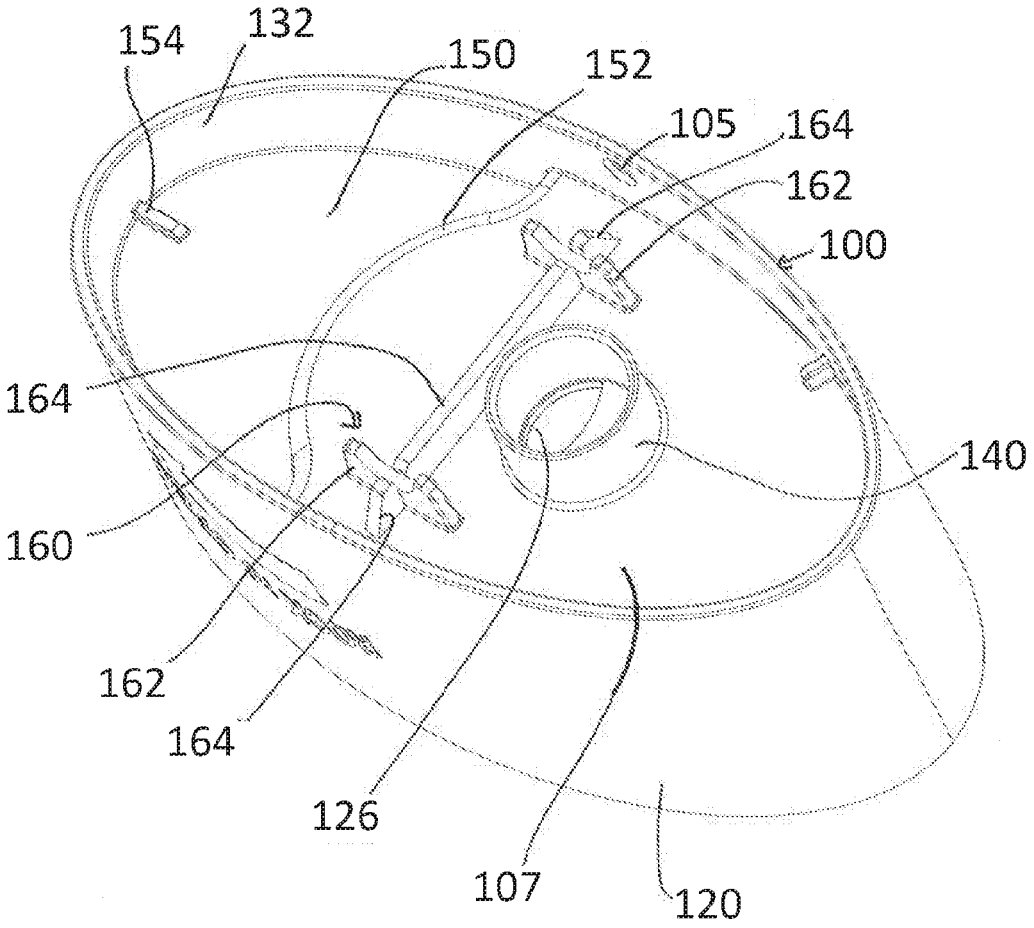
FIG. 6 is a perspective view of the closure shell in accordance with an embodiment of the present invention.
Figure 7:
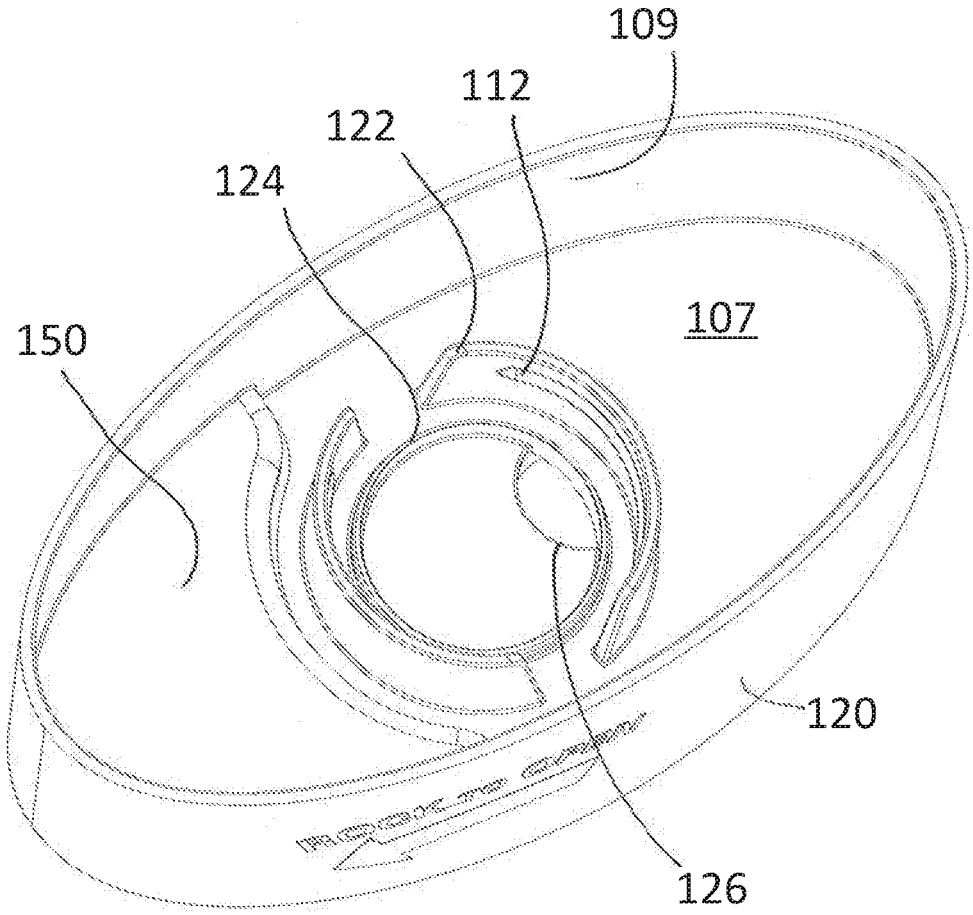
FIG. 7 is another perspective view of the closure shell in accordance with an embodiment of the present invention.
Figure 8:
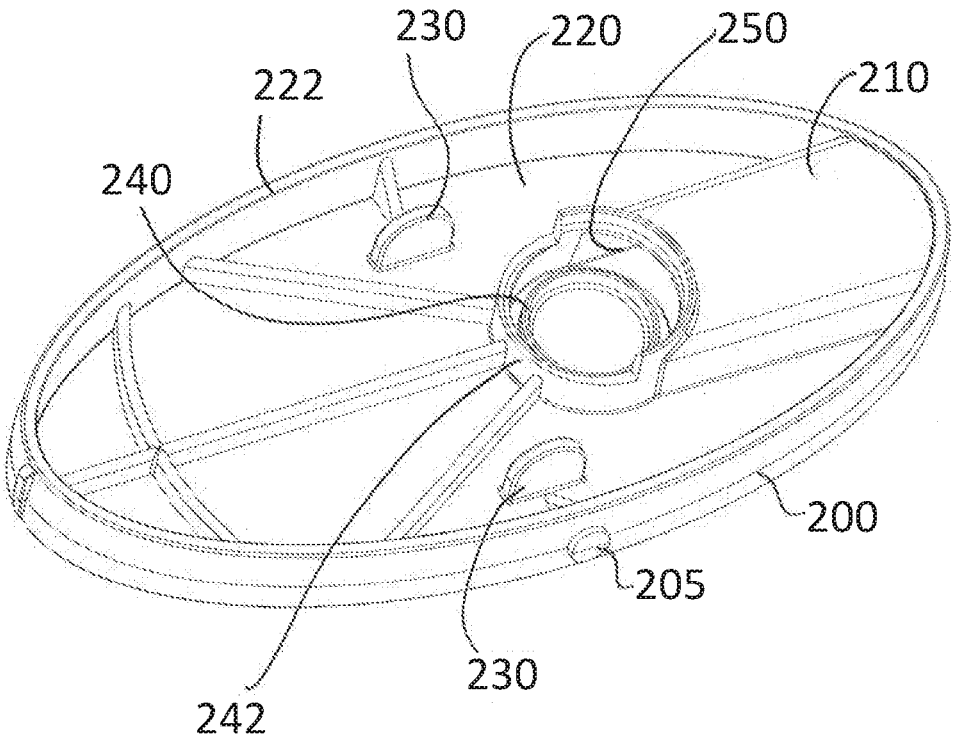
FIG. 8 is a perspective view of the closure cover in accordance with an embodiment of the present invention.
Figure 9:
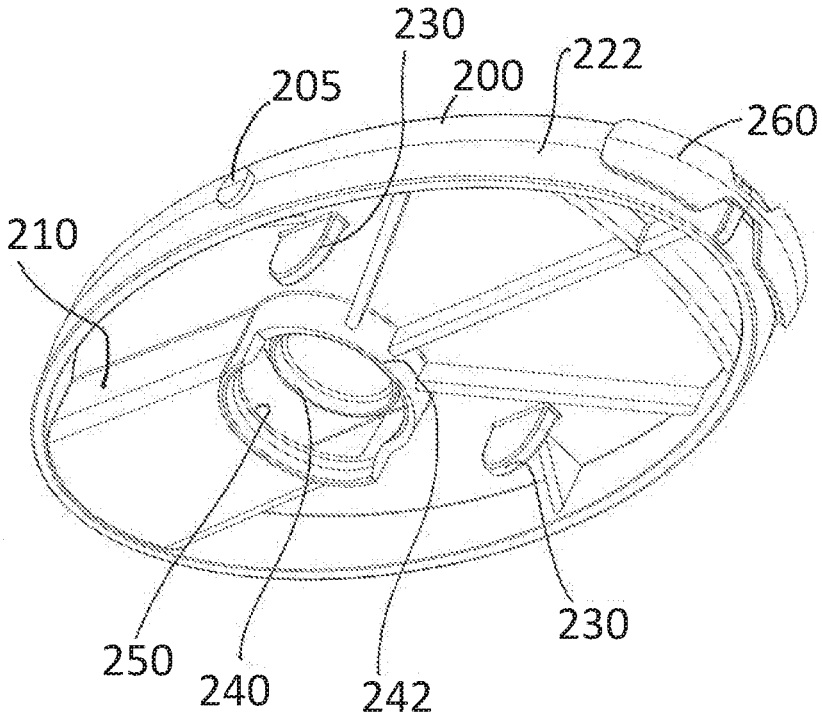
FIG. 9 is another perspective view of the closure shell in accordance with an embodiment of the present invention.
Figure 10:
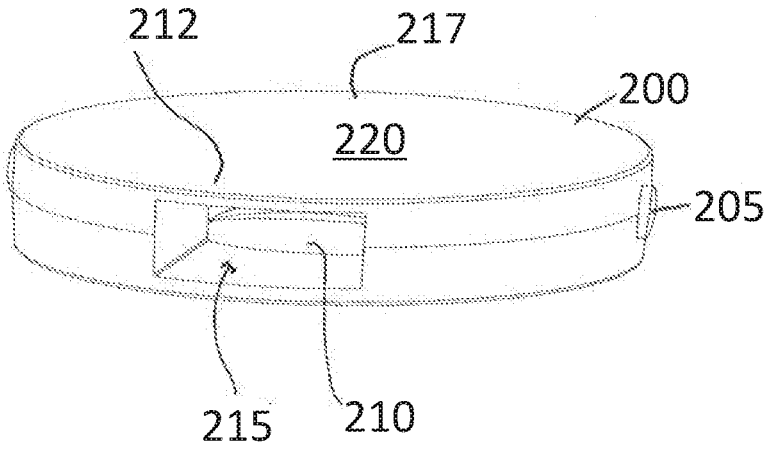
FIG. 10 is another perspective view of the closure shell in accordance with an embodiment of the present invention.

Referring now to FIGS. 1 through 10, there is provided a closure 10 embodying the present invention. The closure 10 is connected to a bottle 5 that includes a neck 7 and opening to the contents contained therein. The closure 10 is a rocker type closure further detailed herein. The closure 10 includes a shell 100 and a rocker cover 200, which fits within a portion of a top section of the shell 100. The rocker cover 200 includes at least one pivot extension member 205 that rests within at least one corresponding recess 105 on the shell 100. When the rocker cover 200 is attached to the shell 100, the pivot extension member 205 is resting within the recess 105, creating a pivotal position across the closure 10. The rocker cover 200 includes a passageway or channel 210 that when the closure 10 is in an open configuration is in direct communication with the contents of the bottle 5, and when the closure 10 is in a closed configuration the channel 210 is closed. The rocker cover 200 can pivot about the pivot position from the open and closed configurations. This is accomplished by a user pressing down on one side or the other side of the rocker cover 200 towards the shell 100. When the in open configuration, the user must press on the channel end 212 (adjacent the channel mouth 215) to close the closure 10. When in the closed configuration, the user can press on the other end 217 that is distal to the channel end 212.

The shell 100 is adapted to attach about the opening of the container 5, by a cap portion 110 extending towards the bottle 5 from a main lateral surface 107 extending from the inner surface 109 of an annual body 120 of the shell 100. The cap portion 110 includes a first wall 122 extending towards the bottle 5 and a second wall 124 extending towards the bottle 5 and interiorly positioned from the first wall 122. The neck of the bottle 5 would thus secure between the first wall 122 and the second wall 124. To help retain the connection to the bottle threads 112, or other forms of attachment, such as a bead, are positioned on the first wall 122 and secure around corresponding structure on the neck of the bottle. The main lateral surface 107 includes an opening 126 positioned internally to the second wall 124 such that the contents of the bottle may flow out of the bottle.

The annual body 120 of the shell 100 includes a first skirt 130 extending towards the bottle and configured to surround top portion of the bottle from the sides of the bottle including the neck and further includes a second skirt 132 extending in an opposite direction of the first skirt 130. Separating the first skirt 130 and the second skirt 132 is the main lateral surface 107.

Extending from the main lateral surface 107 in a direction away from the bottle and extending around the opening 126 is an annular partition wall 140 creating a passage 142 that allows the contents of the bottle to flow from or out of the opening 126 into the annular passage 142. As further defined below, the annular passage 142 is in fluid communication with the channel 210 when the closure 10 is in an opened configuration.

The main lateral surface 107 includes a ledge 152 extending towards the bottle to create a recessed portion 150 adjacent the end 217 that is distal to the channel end 212 of the cover 200. The recessed portion 150 provides a region 153 of the shell 100 that can accommodate a portion of the cover 200 when the end 217 of the cover is pressed into the shell 100, i.e. when in the opened configuration.

The cover 200 includes a top portion 220 terminating at a top skirt 222 extending away from the top portion 220. As noted herein, the top skirt 222 also includes the pivot extension member 205 positioned on the exterior surface thereon and which are aligned with the recess(es) 105. The cover 200 is configured to fit within the second skirt 132 of the shell 100. The top skirt 222 does not extend around the entire top portion 220 as the top skirt 222 is interrupted by the channel 210 and the channel mouth 215.

Extending from the top skirt 222 is an inner annular divider wall 240 sized to engage an inner surface of the annular partition wall 140 when the cover 200 is in the closed configuration. In addition, an outer annular divider wall 242 is configured to engage an outer surface of the annular partition wall 140 (when the closure is in both the closed and opened configuration) and surrounds a portion of the inner annular divider wall 240. The outer annular divider wall 242 further terminates into the channel 210, as such when the closer 200 is in an opened configuration, the contents of the bottle are directed from the passage 142 into the channel entrance 250.

In addition, a flange 154 may further be provided in the recessed portion 150 of the shell 100. The flange 154 may be positioned adjacent to the second skirt 132 to coact with a portion of the top skirt 222 of the cover 200 when in the opened configuration, acting to stop pivoting of the cover 200.

The main lateral surface 107 may further include a pivot guide mechanism 160 positioned about the pivot axis near the recess(es) 105 and adjacent the annular partition wall 140. The pivot guide mechanism 160 includes a pair of u-shaped guides 162 separately positioned towards the recess(es) 105. Flange members 164 may be positioned on either side of the u-shaped guides 162 to help support and keep dog ear extensions 230 extending from the top skirt 222 of the cover 220 in the guides 162. During opening and closing of the cover in relation to the shell, the dog ear extension 230 ride along or pivot along the u-shaped guides 162.

Lastly, as a safety precaution, the top skirt 222 may include a break-away tab 260 that keeps the cover in the closed configuration during transport. The user may tear away the tab prior to its initial use.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

We claim:

1. A closure to secure about a neck defined on a bottle, comprising:

a shell having:

a walled body configured around a main lateral surface, the walled body defining a first skirt and a second skirt extending from the main lateral surface in diametrically opposed directions, the first skirt terminating at a first terminal edge and the second skirt terminating at a second terminal edge, a cap portion extending from the main lateral surface and configured to secure around the neck of the bottle, an opening defined by the main lateral surface positioned about the cap portion such that contents within the bottle may flow through the opening, an annular partition wall extending around the opening in a diametrically opposed direction from the cap portion to define a passage for the contents of the bottle to flow from the opening, and a recessed portion on the main lateral surface;

a cover having:

a top portion terminating to a top skirt that extends from the top portion, a channel having a channel entrance in communication with the passage and a channel mouth exposed in the top skirt such that the contents in the bottle are able to exit the channel from the channel mouth when the cover is in an opened configuration, and an annular divider wall positioned about the channel entrance and sized to seal against an inner surface of the annular partition wall when the cover is in a dosed configuration;

a pivot mechanism configured between the cover and the she to define a pivoting axis across the closure, wherein the top skirt is sized to fit within the second skirt of the shell, such that the top portion of the cover lies substantially flush with the second terminal edge when in the dosed configuration, and wherein the recessed portion on the main lateral surface accommodates a portion of the cover when the cover pivots from the dosed configuration to the opened configuration exposing the channel mouth.

2. The closure of claim 1, wherein the cap portion further includes a first wall extending towards the neck of the bottle and a second wall extending towards the neck of the bottle and being positioned interiorly from the first wall at a distance defined by a thickness of the neck of the bottle, such that when positioned the neck of the bottle is captured between the first and second walls.

3. The closure of claim 1, wherein the main lateral surface includes a ledge extending in a direction to define a recessed portion within the shell and wherein the recessed portion is positioned distal to the channel mouth of the cover and wherein the recessed portion provides a region of the shell to accommodate a portion of the cover when the cover is in the opened configuration.

4. The closure of claim 1, wherein the pivot mechanism is configured as a pair of pivot members positioned on an exterior surface of the top skirt corresponding to a pair of recesses positioned on an interior surface of the second skirt.

5. The closure of claim 4, wherein the pivot mechanism further includes a pair of u-shaped guides and a pair of dog ear extension members configured to rest in the u-shaped guides.

6. The closure of claim 1, wherein the cover further includes an outer annular divider wall configured to engage an outer surface of the annular partition wall when the closure is in both the closed and opened configurations and wherein the outer annular divider wall further terminates into the channel such that when the closure is in an opened configuration, the contents of the bottle are directed from the passage into the channel entrance.

7. The closure of claim 1, wherein the main lateral surface includes a flange in the recessed portion and configured to coact with a portion of the top skirt of the cover when the cover is in the opened configuration.

8. A closure for a bottle having a neck, the closure comprising:

a shell having a main lateral surface, with a pair of diametrically opposed skirts extending therefrom, the shell further has a cap portion configured to secure around the neck of the bottle and an opening in the main lateral surface positioned about the cap portion such that contents within the bottle may flow through the main lateral surface, the shell further having an annular partition extending around the opening in a diametrically opposed direction from the cap portion to define a passage for the contents of the bottle, the shell further includes a recessed portion defined on the main lateral surface;

a cover having a top portion with a top skirt extending from the terminal edge of the top portion, the cover sized to fit within the shell and the cover further having a channel in fluid communication with the passage when the cover is in an opened configuration, and having a channel mouth exposed when in the opened configuration, the cover further having an annular divider configured to seal against the annular partition when the cover is in a closed configuration; and a pivot mechanism configured to allow the cover to pivot in relation to the shell, wherein when in the closed configuration the cover lies substantially flush with an edge of the she and when the cover is pressed on an end diametrically opposed to the channel mouth the cover pivots to the opened configuration and thereby exposes the channel mouth.

9. The closure of claim 8, wherein the cap portion further includes a first wall extending towards the neck of the battle and a second wall extending towards the neck of the bottle and being positioned interiorly from the first wall at a distance defined by a thickness of the neck of the bottle, such that when positioned the neck of the bottle is captured between the first and second walls.

10. The closure of claim 8, wherein the main lateral surface includes a ledge extending in a direction to define a recessed portion within the shell and wherein the recessed portion is positioned distal to the channel mouth of the cover and wherein the recessed portion provides a region of the shell to accommodate a portion of the cover when the cover is in the opened configuration.

11. The closure of claim 8, wherein the pivot mechanism is configured as a pair of pivot members positioned on an exterior surface of the top skirt corresponding to a pair of recesses positioned on an interior surface of the second skirt.

12. The closure of claim 11, wherein the pivot mechanism further includes a pair of u-shaped guides and a pair of dog ear extension members configured to rest in the u-shaped guides.

13. The closure of claim 8, wherein the cover further includes an outer annular divider configured to engage an outer surface of the annular partition when the closure is in both the dosed and opened configurations and wherein the outer annular divider further terminates in the channel such that when the closure is in an opened configuration, the contents of the bottle are directed from the passage into the channel entrance.

14. The closure of claim 8, wherein the main lateral surface includes a flange in the recessed portion and configured to coact with a portion of the top skirt of the cover when the cover is in the opened configuration.

* * * * *